United States Patent [19]

Abe et al.

[11] 4,116,012

[45] Sep. 26, 1978

[54] METHOD OF OBTAINING SUFFICIENT SUPPORTING FORCE FOR A CONCRETE PILE SUNK INTO A HOLE

[75] Inventors: Nobuyuki Abe, Matsudo; Osamu Watanabe, Iwatsuki; Koji Nunokawa; Ichiro Tanaka, both of Kamakura; Masao Manabe, Kawasaki, all of Japan

[73] Assignee: Nippon Concrete Industries Co., Ltd., Tokyo, Japan

[21] Appl. No.: 815,767

[22] Filed: Jul. 14, 1977

[30] Foreign Application Priority Data

Nov. 8, 1976 [JP] Japan ..... 51-133257

[51] Int. Cl.[2] ..... E02D 5/38; E02D 5/44; E21C 17/00

[52] U.S. Cl. ..... 405/238; 175/171; 175/263; 405/239

[58] Field of Search ..... 61/53.6, 45 B, 53.5, 61/53.52, 53.64, 36 R; 175/171, 263, 384, 388, 394

[56] References Cited

U.S. PATENT DOCUMENTS

| | | | |
|---|---|---|---|
| 987,266 | 3/1911 | Smith | 61/53.6 X |
| 1,467,480 | 9/1923 | Hogue | 175/263 |
| 1,706,002 | 3/1929 | Sipe | 61/53.6 |
| 1,751,607 | 3/1930 | Smith | 61/53.6 |
| 2,438,729 | 3/1948 | Upson et al. | 61/53.6 |
| 2,830,443 | 4/1958 | Burrell | 61/53.6 X |
| 2,995,457 | 8/1961 | Lyons et al. | 61/36 R X |
| 3,097,492 | 7/1963 | Salassi | 61/36 R |
| 3,241,325 | 3/1966 | Simons | 61/53.6 |
| 3,326,004 | 6/1967 | Williams | 61/45 B X |
| 3,434,294 | 3/1969 | Hall | 61/53.6 |
| 3,695,045 | 10/1972 | Williams | 61/45 B |
| 3,817,040 | 6/1974 | Stevens | 61/53.5 |
| 3,824,794 | 7/1974 | Hubby | 61/53.6 X |
| 3,831,383 | 8/1974 | Crank | 61/35 |
| 3,864,923 | 2/1975 | Turzillo | 175/394 X |
| 3,875,751 | 8/1975 | Paus | 61/36 R |

*Primary Examiner*—Dennis L. Taylor
*Attorney, Agent, or Firm*—Fidelman, Wolffe & Waldron

[57] ABSTRACT

The present invention relates to a process of setting a concrete pile without noise or vibration which is thereby effective to decrease city noises. A concrete pile is sunk into a leading hole substantially concurrently with the progress of the excavation thereof. After the pile has been sunk through a desired distance, another supporting hole is excavated below the pile. A solidifying material, such as cement milk, mortar, or cement concrete including a cement expansion agent of calcium sulfoaluminate system or lime system, is poured into the supporting hole. The solidifying material is expanded within the supporting hole and permeates into the circumferential wall thereof, which is loosened by the excavation, so as to retighten the wall. Therefore, sufficient supporting force can be obtained.

10 Claims, 6 Drawing Figures

METHOD OF OBTAINING SUFFICIENT SUPPORTING FORCE FOR A CONCRETE PILE SUNK INTO A HOLE

SUMMARY OF THE INVENTION

The present invention relates to a method of obtaining sufficient supporting force for a concrete pile sunk into a hole.

A concrete pile is gradually sunk into a leading hole substantially concurrently with the progress of the excavation thereof. This method does not cause any noise or any vibration. Therefore, it is effective to reduce city noises. However, the supporting force of a concrete pile sunk into a hole is inferior to that of a driven pile. One method of obtaining sufficient supporting force for a pile sunk into a leading hole has been recently developed. In that method, a supporting hole is excavated below a pile after the pile has been sunk through a desired distance and cement milk is poured into the supporting hole so as to stabilize the bottom of the pile. However, the supporting force obtained by the method is not enough. Because, since the circumferential wall of the supporting hole is loosened by the excavation of the hole, cement milk is not sufficiently fixed.

The object of the present invention is to provide a method of obtaining enough supporting force for a pile sunk into a hole.

DETAILED DESCRIPTION OF THE INVENTION

Figures 1, 2, 3:
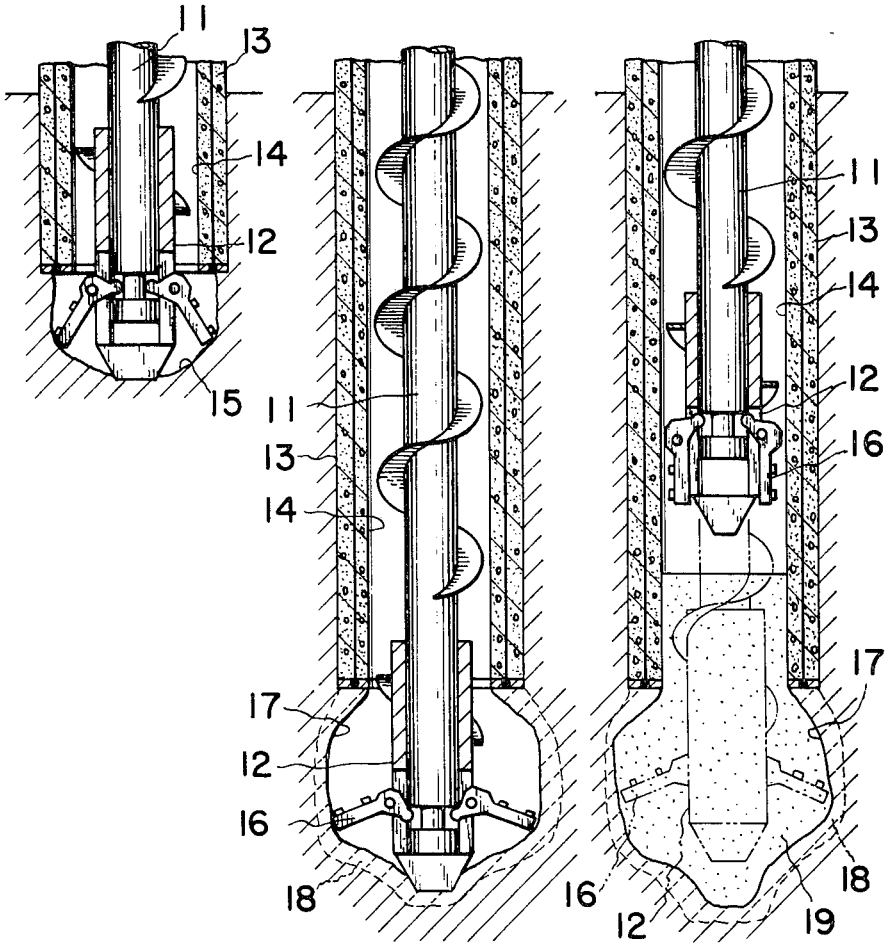
FIG. 1 is a sectional elevation view showing a process a process of excavating a leading hole for a pile.
FIG. 2 is a sectional elevation view showing a process of excavating a supporting hole below the pile.
FIG. 3 is a sectional elevation view showing a process of obtaining sufficient supporting force in accordance with the first embodiment.

In FIG. 1, a screw auger 11 with a bit 12 at the forward end thereof is inserted through a hollow part 14 of a concrete pile 13. A leading hole 15 is bored with the said bit 12, excavated soil is carried above the ground by the screw auger 11, and the concrete pile 13 is gradually sunk into the leading hole 15 substantially concurrently with the progress of the excavation thereof. After the concrete pile 13 has been sunk through a desired distance, vanes 16 of the bit 12 are unfolded to excavate a supporting hole 17 the outer diameter of which is larger than that of the concrete pile 13. In that case, the circumferential wall of the hole 17 is loosened by the excavation in a range 18 shown with a dotted line in FIG. 2.

Figure 4:
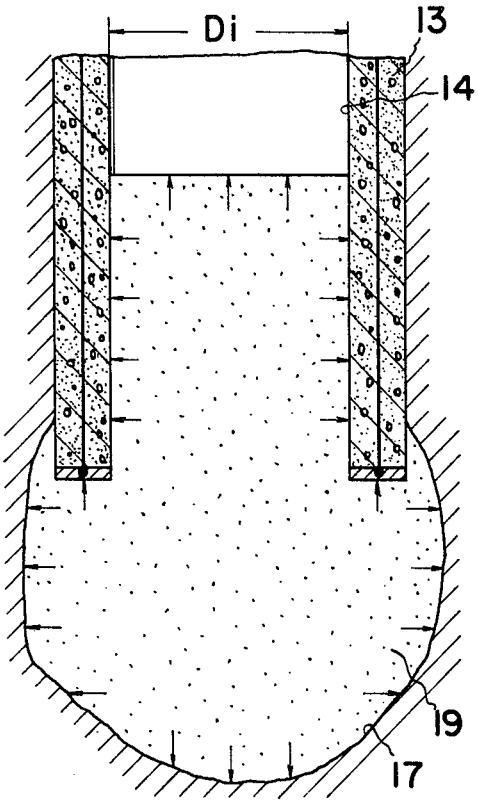
FIG. 4 is a sectional elevation view of a main part for explaining the first embodiment.

In FIG. 3, a solidifying material 19 is poured into the hole 17 from the forward end of the bit 12, and the material 19 and gravel within the hole 17 are stirred with the bit 12 so as to be mixed together. The solidifying material 19 is expanded as the time passes. After the solidifying material 19 has been poured up to a determined height of the hollow part 14 of the pile 13, the screw auger 11 is withdrawn above the ground together with the bit 12. In FIG. 4, the pile 13 is pressed further downward a little so that the forward end of the pile 13 can be sunk into the solidifying material 19 within the hole 17.

In the first embodiment, the solidifying material 19 consists of cement milk or mortar as a main component and cement expansion agent of calcium sulfoaluminate system or lime system. The said solidifying material gradually expands with the hole 17 substantially concurrently with the hardening of cement. Therefore, the circumferential wall of the hole 17 is subjected to expanding pressure as shown in FIG. 4. Loose part 18 of the hole 17 is pushed outward by the expanding pressure so that its durability can be restored. As the result, the pile 13 is securely supported.

Figure 5:
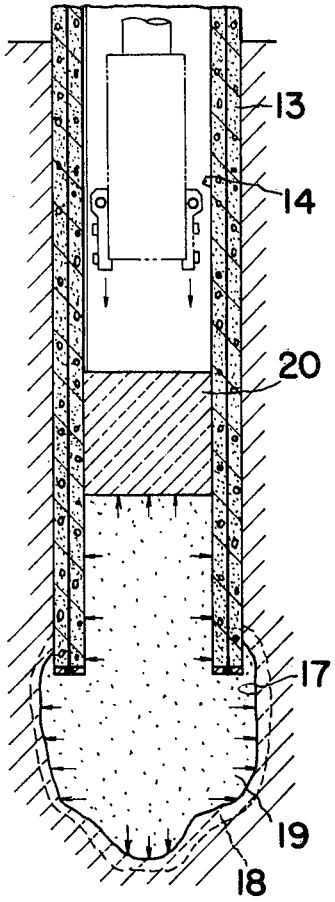
FIG. 5 is a sectional elevation view showing a process of obtaining sufficient supporting force in accordance with the second embodiment.

The second embodiment of the present invention will be described hereinafter. An expanding solidifying material 19 consists of cement milk or mortar as a main component, and a little aluminum powder. The said solidifying material 19 generates gas before cement is hardened, so that it rapidly expands within the hole 17. Because of rapid expansion of gas, the expanding pressure escapes from the hollow part of the pile 13 to the upper part. Therefore, the expanding pressure is not so effective as to retighten the loose part 18 of the hole 17. In the present embodiment, as shown in FIG. 5, a rapidly hardening material 20 to be fixed to the circumferential wall of the hollow part 14 is poured above the solidifying material 19. The hollow part 14 is sealed by the rapidly hardening material 20 so that the expanding pressure is prevented from escaping upward. Since the rapidly hardening material 20 is placed above the solidifying material 19, its specific gravity should be smaller than that of the solidifying material 19. For example, cement suspension containing water glass No. 1, No. 2 or No. 3 or rapidly hardening cement milk may be used.

Cement milk or mortar, which is the main component of the solidifying material 19, permeates into the loose part 18 by the pressure of the gas generated from the solidifying material. The expanding pressure effectively acts in order to retighten the circumferential wall 18 of the supporting hole 17 so that the durability of the supporting hole 17 can be restored. When the solidifying material 19 is completely hardend, the pile 13 is securely supported similarly to the first embodiment.

In the first embodiment, the solidifying material 19 gradually expands concurrently with the hardening of cement, and a frictional force causes at the circumferential wall of the hollow part 14 by the expanding pressure. Accordingly, the expanding pressure never escapes to the upper hollow part, and thereby a rapid hardening material 20 is not required.

Figure 6:
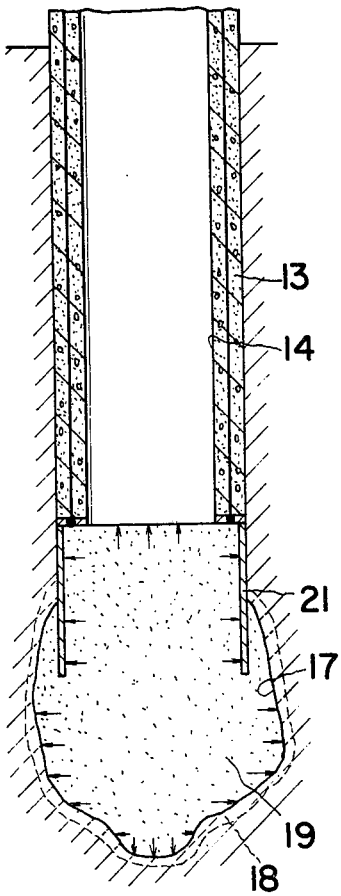
FIG. 6 is a sectional elevation view showing one example of a means to counteract the expansion-pressure.

In the abovementioned two embodiments, the main component of the solidifying material 19 is cement milk or mortar. Therefore, gravel remained within the hole 17 is utilized so as to be mixed into the cement milk or mortar. If it is estimated that only very little gravel is remained, or if neither stirring nor mixing is executed with the bit, it is preferable to use cement concrete as the main component of the solidifying material 19. In the abovementioned embodiments, expanding agent is previously mixed with the main component of the solidifying material 19. It is also possible to execute the mixing when the solidifying material 19 is poured into the supporting hole and stirred therein. The expansion ratio of the solidifying material can be selected by the mixture ratio of the expanding agent to cement, and further the expanding pressure can be selected by the expansion ratio. If the expanding pressure is selected so as to be large, a steel tube or a steel band may be provided at the forward end of the pile 13, for example inserted into the hollow part 14 or attached to the outer periphery, or other various reinforcing means (For example, as shown in FIG. 6, a steel tube 21 is fixed to the bottom of the pile 13 in order to counteract the expansion-pressure.) may be provided in order to reinforce the pile.

Table 1 shows concrete examples of the first and second embodiments.

Table 1

| | | First Embodiment | Second Embodiment First Ex. | Second Embodiment Second Ex. |
|---|---|---|---|---|
| Solidifying Material | main component | cement milk | cement milk | mortar |
| | ratio of water to cement | more than 45% | more than 45% | more than 55% |
| | expanding agent | Lime system | aluminum powder | aluminum powder |
| | ratio of the expanding agent to cement | 5 - 30 % | 0.07-0.09 % | 0.09-0.11 % |
| Rapidly Hardening Material | | | cement suspension containing water glass | |
| Necessary Length of the Rapidly Hardening Material | | | more than 1 × Di | |
| Expansion Ratio (Volume Ratio) | | 110 - 130 % | 200 - 220 % | |
| Expanding Pressure | | more than 10 Kg./cm$^2$ (Reinforcement of a pile is required.) | less than 10 Kg./cm$^2$ (Reinforcement of a pile is not required.) | |

In the abovementioned description, a leading hole is excavated, a pile is sunk into the leading hole concurrently with the progress of its excavation, and after the pile has been sunk through a desired distance, another hole the diameter of which is larger than that of the pile is excavated below the pile. The present invention is not limited to the excavation of a large diameter hole below a pile. Similar effect can be displayed in other general processes. For example, similarly to the case shown in FIG. 1, a bit the outer diameter of which is approximately the same as the inner diameter of a hollow part 14 of a pile 13 is attached at the forward end of a screw auger 11, the auger 11 is inserted through the hollow part 14 of the pile 13, a leading hole 15 the diameter of which is approximately the same as the inner diameter of the pile is excavated below the pile 13, and the pile 13 is gradually sunk into the leading hole 15 as the excavated soil is carried above the ground with the screw auger 11, and consequently after the pile 13 has been sunk through a desired distance, the excessive leading hole 15 (corresponding to the hole 17 described in the above embodiments) is filled with a solidifying material 19. Therefore, the loose circumferential wall of the excessive leading hole 15 is retightened. As the result, the diameter of the excessive hole 15 is made a little larger than that of the pile, and thereby the pile is securely supported in a larger area.

The effects of the present invention are as follows.

(1) The circumferential wall of a supporting hole which has been loosened by the excavation is retightened by the effect of an expanding solidifying material, so that the supporting force is increased and the stability of the pile is improved.

(2) The diameter of the supporting hole is made larger by the expansion and permeation of the solidifying material.

(3) The forward end of the hollow part of the pile is plugged by the solidifying material or the rapidly hardening material.

Moreover, since the ascent of the underground water into the hollow part of the pile can be prevented, the supporting force is increased.

We claim:

1. A method for setting a concrete pile and obtaining secure support for the lower end of the pile which comprises:

inserting a screw auger having a bit at the forward end thereof through a hollow concrete pile and rotating said auger and bit to bore a leading hole just below the lower end of said pile, and advancing the pile into the hole until the desired depth is reached;

excavating a hole having a diameter at least as large as the diameter of the pile underneath the lower end of the pile;

completely filling the hole excavated underneath said pile with a cementitious material and rotating said bit so as to mix the cementitiuos material with gravel and debris remaining in the hole after excavation, said cementitious material containing from about 5% to 30% of an expanding agent selected from the group consisting of calcium sulfoaluminate and lime and displaying substantial expansion upon hardening;

withdrawing the auger from the pile, and seating the pile within the cementitious material by advancing the pile a short distance downwardly into said material to further compact the cementitious material below the lower end of the pile and to obtain a secure support for the pile as the cementitious material expands upon hardening.

2. The method of claim 1 wherein the expanding pressure developed by said cementitious material is more than 10 kilograms per square centimeter.

3. The method of claim 2 wherein said cementitious material contains a lime expanding agent.

4. A method of obtaining sufficient supporting force for a concrete pile sunk into a hole, as claimed in claim 1, in which a supporting hole is excavated in such a manner that the diameter of the hole is larger than that of the pile.

5. A method of obtaining sufficient supporting force for a concrete pile sunk into a hole, as claimed in claim 1, in which a supporting hole is excavated in such a manner that the diameter of the hole is substantially the same as that of the pile.

6. A method for setting a concrete pile and obtaining secure support for the lower end of the pile which comprises:

inserting a screw auger having a bit at the forward end thereof through a hollow concrete pile and rotating said auger and bit to bore a leading hole just below the lower end of said pile and advancing the pile into the hole until the desired depth is reached;

excavating a hole having a diameter at least as large as the diameter of the pile underneath the lower end of the pile;

completely filling the hole excavated underneath said pile with a cementitious material and rotating said bit so as to mix the cementitious material with debris remaining in the hole after excavation; said cementitious material containing an aluminum powder gas generating agent in sufficient amount to cause a substantial expansion of said cementitious material;

emplacing a second cementitious material in the lower portion of said pile in a layer atop said first cementitious material, said second cementitious material having a lower specific gravity and a shorter setting time than said first cementitious material whereby said second cementitious material forms a seal and prevents escape of gas from said first cementitious material thereby causing said first cementitious material to expand within said excavated hole to provide a secure support for the pile, and withdrawing the auger from the pile before either of said cementitious materials harden.

7. A method of obtaining sufficient supporting force for a concrete pile sunk into a hole, as claimed in claim 6, in which a supporting hole is excavated in such a manner that the diameter of the hole is larger than that of the pile.

8. A method of obtaining sufficient supporting force for a concrete pile sunk into a hole, as claimed in claim 6, in which a supporting hole is excavated in such a manner that the diameter of the hole is substantially the same as that of the pile.

9. The method of claim 6 wherein the expanding pressure developed by said gas generating agent contained in said first cementitious material is less than 10 kilograms per square centimeter and wherein said gas generating agent is aluminum powder.

10. The method of claim 6 wherein the pile is seated within the cementitious material by advancing the pile a short distance downwardly into said material whereby a secure support for the pile is obtained by expansion of the cementitious material upon hardening.

* * * * *